United States Patent [19]

Fisher et al.

[11] Patent Number: 4,581,323

[45] Date of Patent: Apr. 8, 1986

[54] PHOTOTHERMOGRAPHIC ELEMENT HAVING TOPCOAT BLEACHABLE ANTIHALATION LAYER

[75] Inventors: Michael G. Fisher, Epping, England; Gebran J. Sabongi, Woodbury, Minn.; Stephen S. C. Poon, Harlow, England

[73] Assignee: Minnesota Mining and Manufacturing Company, St. Paul, Minn.

[21] Appl. No.: 588,913

[22] Filed: Mar. 12, 1984

[30] Foreign Application Priority Data

Mar. 15, 1983 [GB] United Kingdom ..... 8307022

[51] Int. Cl.[4] ..... G03C 1/84

[52] U.S. Cl. ..... 430/513; 430/510; 430/517; 430/519; 430/522; 432/619; 432/620

[58] Field of Search ..... 430/513, 510, 517, 619, 430/620, 519, 522

[56] References Cited

U.S. PATENT DOCUMENTS

| | | | |
|---|---|---|---|
| 2,026,964 | 1/1936 | Capstaff | 430/513 |
| 3,627,527 | 12/1971 | Gilman et al. | 96/1.6 |
| 4,271,263 | 6/1981 | Goettert et al. | 430/513 |
| 4,316,950 | 2/1982 | Cincotta et al. | 430/513 |
| 4,345,217 | 8/1982 | Cournoyer et al. | 530/513 |
| 4,376,162 | 3/1983 | Kawata et al. | 430/513 |

OTHER PUBLICATIONS

Chao-Tung Chen, Shou-Jen Yan, and Ju-Chu Ho—Authors, Dyes Derived from Furfural, Aniline, and Organic Acids, pp. 49-60.

Elliot N. Marvell, Gerald Caple, and Iraj Shahidi—Authors, Formation of Phenylpyridinium Chloride from 5-Anilino-N-phenyl-2,4-pentadienylideniminium Chloride, Kinetics in Basic Media, pp. 5641-5649.

Elliot N. Marvell, Gerald Caple and Iraj Shahidi, Authors, Mechanism of the Formation of Phenylpyridinium Chloride from 1,7-Diphenyl-1,7-Diazahepta-1,3,5-Triene, pp. 277-280.

Elliot N. Marvell, Thomas H. Li and Chang Paik—Authors, Formation of Phenylpyridinium Chloride from 5-Anilino-N-Phenyl-2,4-Pentadienylideniminium Chloride in Acidic Media, pp. 2089-2092.

K. G. Lewis and C. E. Mulquiney—Authors, Tetrahedron Report, No. 26, Aspects of the Formation and Use of Stenhouse Salts & Related Compounds, pp. 463-475.

J. Chem. Soc.—C. F. Koelsch & J. J. Carney—Authors Notes—May 1950, pp. 2285-2286, vol. 72.

J. C. McGowan—Author, The Preparation of Bases from the Coloured Compounds formed by Condensation of Furfuraldehyde with Aromatic Amines, pp. 777-779.

*Primary Examiner*—Jack P. Brammer

*Attorney, Agent, or Firm*—Donald M. Sell; James A. Smith; Mark A. Litman

[57] ABSTRACT

A photothermographic element comprising a reflective base having coated thereon one or more layers constituting a photothermographic imaging medium in which a bleachable antihalation medium is coated over said photothermographic imaging medium, the components of the antihalation medium being in non-reactive association with components in the photothermographic imaging medium. The topcoat antihalation layer allows a wide latitude in the selection of dye bleach systems and binders and surprisingly is at least as effective as the use of antihalation underlayers.

18 Claims, 6 Drawing Figures

PHOTOTHERMOGRAPHIC ELEMENT HAVING TOPCOAT BLEACHABLE ANTIHALATION LAYER

FIELD OF THE INVENTION

This invention relates to photothermographic elements and in particular to such elements incorporating a bleachable antihalation layer over and separate from the photothermographic imaging medium.

BACKGROUND OF THE INVENTION

The use of antihalo dyes for light sensitive elements is well known. The most common application is for silver halide based films coated on a transparent supporting medium. Light passing through the sensitive layer can be internally reflected from the back surface of the support, and re-illuminates the sensitive layer some distance laterally from the original point of exposure. This exposure is readily visible as a "halo" if the image is that of a bright point source.

The most common uses of antihalo dyes are in the form of a backing, coated on the support. This is destroyed during processing, either mechanically or chemically. In an alternative construction a dye may be coated between the sensitive layer and the support, and destroyed chemically during processing. A further construction involves the use of grey-dyed base as used in many fast negative camera films. Dyes have also been used as underlayers, below the sensitive layers, in X-ray films, where a sensitive layer is coated on each side of the support. The dye prevents radiation passing through one sensitive layer and exposing the layer on the opposite side. Such additional exposure is known to give rise to greatly decreased sharpness, even though the image of a bright point source would not be rendered as a distinct halo.

The degree of halation or light spread is particularly troublesome in all of the materials mentioned above since the light traverses several times the thickness of the transparent base before re-exposing the layer. Therefore, in all of the above described applications the antihalo dye is intended to absorb substantially all of the unwanted radiation, although some benefit is to be gained by partial absorption. The decrease in exposure, and therefore of the apparent sensitivity of the material, caused by the presence of the antihalo dye is seen to be a small disadvantage compared with the advantage of increased image sharpness.

The uses of antihalo dyes so far described are applied to coatings on substantially transparent base. In the case of a transparent layer of refractive material such as gelatin or other polymer coated on a diffusely reflecting opaque support, light striking the support is reflected at all angles within the transparent medium. Although some light escapes from the surface a considerable fraction, usually over 50%, is totally reflected at the gelatin or polymer/air interface. This light re-illuminates the base in a manner analogous to that described above. The light from the base gives rise to a succession of multiple reflections between the base and the polymer/air interface.

When the polymer layer contains a light sensitive element, the multiple reflections are, to some extent, limited by absorption of light within the layer. However, many sensitive materials are sufficiently transparent to the exposing radiation that multiple reflections are still possible. It follows that the light sensitive material receives multiple exposures from successive passages of the light across the layer, much of the exposure taking place at distances from the original point of entry that are large compared with the layer thickness. The result is that the sensitive layer displays higher apparent sensitivity but lower image sharpness than the same formulation coated on a non-reflecting support such as a backed film. Simple geometrical optics leads to the conclusion that, if exposure can be expressed as the integration of light flux density multiplied by the distance travelled within the layer, a totally transparent non-scattering material will receive over nine times the exposure received by the material on an absorbing support.

The distance between the polymer-air interface and the reflecting base is usually much less than the thickness of a transparent base; furthermore the image sharpness is usually much lower than that demanded from films coated on transparent base, and therefore much of the exposure arising from the internal reflections can be utilised for little or no apparent loss of image sharpness. The degree to which the loss of image sharpness can be tolerated depends on the particular application. Therefore antihalo layers applied to materials coated on reflecting base should preferably be only partially absorbing.

Examples of light sensitive materials comprising a reflective support bearing a substantially transparent light sensitive medium are photothermographic materials, particularly those commonly referred to as "dry silver systems".

Dry silver systems which comprise a thermally developable photosensitive mixture of light sensitive silver halide with a silver salt of an organic fatty acid, e.g. behenic acid, are disclosed, for example, in U.S. Pat. Nos. 3,152,904 and 3,457,075. Known dry silver systems have employed antihalation and/or acutance dyes in order to ensure a sharp image, the antihalo dyes being stable under the manufacture and storage conditions of dry silver but readily bleachable during or after the heat development step. The antihalation layers containing the bleachable dyes have been positioned between the support and photosensitive layer(s), between photosensitive layers and, in the case when a transparent support has been used, on the side of the support opposite the photosensitive layers(s).

Known dyestuffs and processes suitable for antihalo applications in dry silver systems include thermally bleachable dyes as disclosed in U.S. Pat. Nos. 3,745,009, 4,033,948, 4,088,497, 4,153,463 and 4,283,487; photobleachable o-nitroarylidene dyes as disclosed in U.S. Pat. No. 4,028,113; and thermochromic dyes as disclosed in U.S. Pat. No. 3,769,019.

British Patent Specification No. 1 588 097 discloses heat bleachable compositions for use in photography comprising a benzopinacol which forms ketyl radicals on heating to a temperature above 100° C. and a dye which is bleached by ketyl radicals. The heat bleachable compositions are useful in photothermographic systems as antihalation layers when coated between the support and a light sensitive layer or on the back of a transparent support. The compositions may also be used in photothermographic systems as a light screening layer coated directly on top of the light sensitive layers or between two light sensitive layers in order to completely absorb light of unwanted wavelength but remain transparent to light of the desired wavelength.

British Patent Application No. GB 2 004 380A discloses heat bleachable compositions for use in photography comprising a hexaaryl biimidazole and a dye which is bleached upon reaction with a product formed on heating the hexaaryl biimidazole. The compositions are useful as antihalation and filter layers in a variety of photographic materials. For antihalation purposes, they may usefully be in a layer (or group of adjacent layers) between the photosensitive layer and the support, in the support itself or, if the support is transparent, in a layer (or group of adjacent layers) coated on the side of the support opposite to that carrying the photosensitive layer.

Heretofore the use of antihalo dyes in photothermographic systems has been limited to their presence in an antihalation underlayer positioned beneath the light sensitive medium, an antihalation layer positioned between two light sensitive layers, an antihalation backside coating on a transparent support and the presence of acutance dyes in one or more layers constituting the light sensitive medium.

British Patent Specification No. 2 054 184B discloses an example of an antihalo dye deliberately intended to give partial absorption. This Patent discloses a photographic material sensitive to visible radiation and having at least one silver halide emulsion layer, the uppermost emulsion layer having an antihalation coating which has an absorption maximum in the spectral range in which said uppermost emulsion layer has its maximum sensitivity and which has an optical density of at least 0.10 at the said absorption maximum. Light which is scattered back towards the top surface of the layer can be totally internally reflected and re-enter the sensitive layer, producing additional loss of image sharpness. The effect is greatest when the sensitive layer is below several others which are substantially transparent to the radiation in question. By coating a dye in the surface of the material the light that is internally reflected is attenuated, giving a useful interchange between image sharpness and sensitivity. Because the dye is above the sensitive layer, it must be traversed by the exposing radiation before any of it reaches the sensitive layer. Therefore, it must only cause partial absorption in order to be useful.

The necessity for the additional layer arises from the use of a sensitive medium sufficiently scattering to produce back reflection from within the layer carrying the medium. Thus, the use of an antihalo dye behind the sensitive layer would be necessary but not sufficient for the materials described. The case of photothermographic elements coated on a reflecting base is different in that substantially no back-scatter from the sensitive medium occurs and therefore only an antihalo layer is required to quench multiple reflections between the base and polymer-air interface.

The presence of a heat bleachable topcoat antihalation layer on photothermographic elements has not been used or considered desirable in the prior art on the assumption that the presence of such a topcoat in sufficient quantity to increase image sharpness would significantly reduce sensitivity of the material, and be less efficient compared to the use of antihalation underlayers and backside layers.

It has now been found that the presence of a bleachable antihalation topcoat on photothermographic elements may provide a balance of sensitivity and image sharpness which surprisingly is comparable to and often superior to that obtained using acutance dyes or antihalation underlayers.

SUMMARY OF THE INVENTION

Therefore according to the present invention there is provided a photothermographic element comprising a reflective base having coated thereon one or more layers constituting a photothermographic imaging medium and a bleachable antihalation medium coated over said photothermographic imaging medium, the components of the antihalation medium being in non-reactive association with components in the photothermographic imaging medium.

DETAILED DESCRIPTION OF THE DRAWINGS

FIGS. 1A to 1C of the accompanying drawings represent cross-sections of dry silver elements indicating the various possible positions of one or more additional layers incorporating antihalo dye(s).

FIG. 2 represents a plot of image spread against log exposure (in excess of that necessary to give a reflectance optical density of 1.3) which summarises the results of tests conducted on a dry silver element bearing a topcoat bleachable antihalation layer in accordance with the invention and reference dry silver elements having no antihalation layer or an antihalation underlayer. The improvement in image quality is essentially indicated with the gradient of the line, the lower gradient indicating lower image spread. The detailed experimental conditions are reported in Example 1.

Figure 1A:
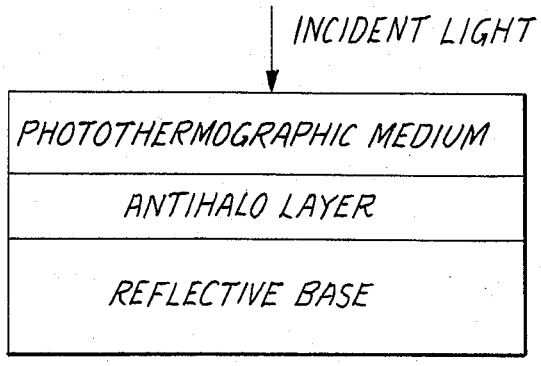

The antihalation layer used in the invention must contain one or more dyes in an amount to provide an optical density of transmission which is sufficient for antihalation purposes but not too high to prevent sufficient light passing through to the light sensitive medium to maintain the desired sensitivity. The transmission optical density of the antihalation layer will be selected within the range 0.05 to 0.4, preferably 0.1 to 0.25. Due to the extremely non-linear relationship between transmission and reflection density, the transmission density range of 0.05 to 0.4 may give apparent reflection densities of about 0.3 to 1.4 to the coated layer, the exact relationship depending on the optical density of the other elements present.

The dyes must be bleachable to a transparent moiety which is preferably colourless. The chemical or physical routes by which colour destruction of the antihalo dye is achieved are not important although a heat or light bleaching system is preferred since these are compatible with the dry thermal processing development of the elements. Any other components necessary to complete a dye/bleach system to allow bleaching of the antihalation layer must be in reactive association with the antihalo dye, preferably in the same layer as the antihalo dye although it is possible for such components to be coated as a separate layer adjacent the antihalation layer providing there is sufficient migration or diffusion for reactive association. The components of the dye/-bleach system should not interfere with components of the photothermographic imaging medium.

As well as providing a comparable or better balance of sensitivity and image sharpness properties in dry silver elements compared with the use of antihalation underlayers or acutance dyes as will be described hereinafter, the antihalation topcoat of the invention has significant advantages in relation to the commercial preparation of dry silver elements.

It is only necessary for a topcoat to withstand a single passage through a drying oven compared to two or three drying treatments in the case of an underlayer. Drying conditions may involve the element being subjected to temperatures of 80° C. or more for periods of 3 minutes. Some dye compositions which bleach at a satisfactory rate under the development conditions of dry silver systems, e.g. 127° C., will begin to bleach under the drying conditions and if two or more passages through the drying oven are required such compositions may have bleached to such an extent to render the antihalation layer inefficient. Thus, the use of a topcoat antihalation layer allows more latitude in selecting heat bleachable dye systems and in particular allows the selection of systems which bleach rapidly at temperatures below the development temperature of the dry silver system.

Furthermore, the topcoat antihalation layer is separate from the components of the imaging medium and accordingly the bleachable dye system can be selected without having to ensure compatibility with these components. Thus, a wide selection of bleachable chemistries may be employed.

A further advantage is that a wide choice of binders may be used for the antihalation topcoat since the layer is not subjected to overcoating with one or more layers forming the imaging medium and accordingly compatibility between the binders of the antihalation and imaging layers is not so critical.

The base of the photothermographic element of the invention is diffusely reflective. If the reflection from the base is fully diffuse, and the polymeric binder has a refractive index of approximately 1.5, about 60% of the reflective light is totally internally reflected at the binder/air interface. However, a base with a degree of directional reflectivity that allows a smaller fraction of the radiation, say 20%, to be totally internally reflected can be taken to be diffusing.

Although the absence of coated layers on the surface of the base may alter its diffuse reflectivity (e.g. when the polymeric binder may no longer be absorbed by pigment particles on the surface of the base), it is recognised that the measurement of diffuse reflectivity of the bare base using conventional photometry with integrating spheres or using reflection densitometry, is sufficient to describe the degree of diffusion.

The bases for use with this invention will generally have reflectivities of 75% or more, preferably above 80%, and will act as completely diffusing surfaces.

Suitable base materials include paper and plastics film. Papers of photographic quality possessing very even surfaces, such as are found in commercial photothermographic elements, are preferred; more preferably they contain diffuse reflecting pigment particles such as titanium dioxide or baryta. Paper coated with titanium dioxide and resin, and having a reflectivity of approximately 90% have been shown to be useful for this invention.

Plastics film materials are preferably composed of polyester containing diffuse reflecting pigment particles, e.g. titanium dioxide, or containing finely dispersed air bubbles. A useful grade of such vesicular polyester film base has a reflectivity of approximately 85%.

In general, the bases of the invention will be opaque. High degrees of opacity are preferred in order to minimise back-scatter from the furthermost surface of the base and, alternatively, to aid viewing because the element is viewed by reflection. However, vesicular polyester base is useful although approximately 10 to 15% of the incident light may pass through the base.

The photothermographic medium may be selected from any of the known systems, e.g. those disclosed in the above referenced patents. Preferred photothermographic media are dry silver systems comprising a thermally developable mixture of light sensitive silver halide with a silver salt of an organic fatty acid, e.g. behenic acid, and a mild reducing agent. The photothermographic medium is preferably non-scattering. The components of the medium may be coated in one or more layers. The components of the photothermographic medium and the bleachable antihalation layer are maintained in non-reactive association, if necessary by the presence of a barrier layer between the antihalation and imaging layers, and accordingly the photothermographic medium and the dye/bleach system may be selected without the necessity of ensuring the components of the two systems do not inter-react.

The bleachable dye used in the antihalation layer of the invention may be any dye which is capable of being bleached to a transparent, preferably colourless, moiety under conditions which do not deleteriously affect the image quality of the photothermographic material. Examples of known bleachable dye systems are disclosed in U.S. Pat. Nos. 3,745,009, 4,003,948, 4,088,497, 4,153,463, 4,283,487, 4,028,113 and 3,769,019.

Other dye/bleach systems have recently been developed which are particularly suited to use in the antihalation layer of the invention since they allow the antihalo dye to be selected from a wide range of dyes, many of which are commercially available and have been used in conventional wet-processed colour photographic materials. These dye/bleach systems include:

(1) The combination of a polymethine dye with a mesoionic compound, e.g. a sydnone, allows the dye to be bleached on exposure to radiation (UV, IR or visible light) corresponding to the longest wavelength absorption peak of the mesoionic compound. The polymethine dyes are compounds having at least one electron donor group and one electron acceptor group, linked by methine groups or azo analogues, and include allopolar cyanine, complex cyanine, hemicyanine, merocyanine, oxonol, streptocyanine dyes and dyes of the quinone type, e.g. anthraquinone, indanine, indoaniline and indophenol dyes. The weight ratio of dye:mesoionic compound is generally in the range 1:1 to 1:50.

Typical bleachable dyes for use with mesoionic compounds have the general formula:

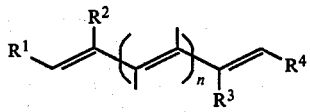

(I)

in which:

n is an integer of 1 to 5, and $R^1$ to $R^4$ are selected to provide an electron donor moiety at one end of the conjugated chain and an electron acceptor moiety at the other, and represent halogen, alkyl, aryl groups or heterocyclic rings any of which may be substituted, said groups generally containing up to 14 atoms selected from C, N, O and S; or $R^1$ and $R^2$ and/or $R^3$ and $R^4$ may represent the necessary atoms to complete optionally substituted aryl groups or heterocyclic rings, generally containing up to 14 atoms selected from C, N, O and S.

The conjugated chain is preferably composed of carbon atoms but may include one or more nitrogen atoms providing the conjugation is not disrupted. The free valences on the chain may be satisfied by hydrogen or any substituent of the type used in the cyanine dye art including fused ring systems.

Preferred mesoionic compounds contain a five-membered ring, containing carbon and at least one of N, O and S. This ring is substituted preferably by oxygen (or sulphur). Such compounds have found application as pharmaceuticals, organic synthesis, as cross-linking agents for polymers, as photochromics and as latent image stabilisers in silver halide photography. A preferred class within this group are the 1,2,3-oxadiazolium-5-olates known as sydnones.

Sydnones can be generally described by the structure:

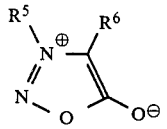

(II)

in which:

$R^5$ represents an alkyl or aryl group or a heterocyclic ring, any of which groups may be substituted and preferably represents an aryl or heterocyclic ring and more preferably substituted aryl or substituted heterocyclic ring, and $R^6$ represents an alkyl or aryl group either of which may be substituted, a hydrogen atom, an amino or an alkoxy group, preferably $R^6$ represents a hydrogen atom.

The groups $R^5$ and $R^6$ generally contain up to 14 atoms selected from C, N, O and S.

(2) The combination of a polymethine dye of the type described above having an oxidation potential between 0 and +1 volt, and an iodonium salt, the cation of which comprises a positively charged iodine atom bearing covalently bonded carbon atoms. This dye bleach system usually has its greatest sensitivity at the $\lambda_{max}$ of the longest wavelength absorbance peak of the dye. The weight ratio of dye to iodonium salt is generally in the range 1:1 to 1:50, usually 1:2 to 1:10.

Suitable iodonium salts may be represented by the formula:

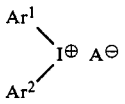

(III)

in which:

$Ar^1$ and $Ar^2$ independently represent carbocyclic or heterocyclic aromatic-type groups generally having from 4 to 20 carbon atoms, or together with the iodine atom complete a heterocyclic aromatic ring.

These groups include substituted and unsubstituted aromatic hydrocarbon rings, e.g. phenyl or naphthyl, which may be substituted with alkoxy groups, e.g. methyl, alkoxy groups, e.g. methoxy, chlorine, bromine, iodine, fluorine, carboxy, cyano or nitro groups or any combination thereof. Examples of heteroaromatic groups include thienyl, furanyl and pyrazolyl which may be substituted with similar substituents as described above. Condensed aromatic/heteroaromatic groups, e.g. 3-indolinyl, may also be present.

$A^\ominus$ represents an anion which may be incorporated into $Ar^1$ or $Ar^2$.

Preferably $Ar^1$ and $Ar^2$ do not have more than two substituents at the $\alpha$ positions of the aryl groups. Most preferably $Ar^1$ and $Ar^2$ are both phenyl groups containing no $\alpha$ substituents.

Any anion may be used as the counter-ion $A^\ominus$ provided that the anion does not react with the iodonium salt. Suitable inorganic anions include halide anions, $HSO_4^\ominus$, and halogen-containing complex anions, e.g. tetrafluoroborate, hexafluorophosphate, hexafluoroarsenate and hexafluoroantimonate. Suitable organic anions include those of the formula:

$$RCOO^\ominus \text{ or } RSO_3^\ominus$$

in which R is an alkyl or aryl group of up to 20 carbon atoms,, e.g. a phenyl group, either of which may be substituted. Examples of such anions include $CH_3COO^\ominus$ and $CF_3COO^\ominus$.

$A^\ominus$ may be present in $Ar^1$ or $Ar^2$, e.g.

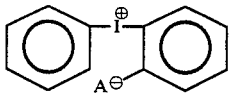

(IV)

in which $A^\ominus$ represents $COO^\ominus$, etc.

Furthermore, $A^\ominus$ may be present in a molecule containing two or more anions, e.g. dicarboxylates containing more than 4 carbon atoms.

The most significant contribution of the anion is its effect upon the solubility of the iodonium salt in different solvents or binders. This criterion is also important for systems fixed by removal of the unreacted iodonium ion in an aqueous processing step where good solubility of the iodonium salt in water is essential.

Most of the iodonium salts are known, they may be readily prepared and some are commercially available. The synthesis of suitable iodonium salts is disclosed in F. M. Beringer et al, Journal of the American Chemical Society, 80, 4279 (1958).

(3) A bleachable dye of the formula:

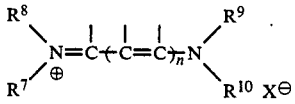

(V)

in which:

n is 2, 3, 4 or 5, at least one of $R^7$ to $R^{10}$ represent hydrogen and the remainder of $R^7$ to $R^{10}$ independently represent a hydrogen atom, an optionally substituted alkyl group, an optionally substituted cycloalkyl group, an optionally substituted alkenyl group, an optionally substituted aryl group, an optionally substituted heterocyclic aromatic group, or $R^7$ and $R^8$ together or $R^9$ and $R^{10}$ together represent the necessary atoms selected from C, N, O and S to complete a non-aromatic type ring, $X^{\ominus}$ is an anion, the free bonds of the polymethine chain being satisfied by hydrogen or any chain substituent of the type present in known cyanine dyes, the bleachable dye optionally being in reactive association with a mild reducing agent.

There are many known dyes within the scope of formula (V) and a general review of such dyes is provided in "Rodd's Chemistry of Carbon Compounds", S. Coffrey, Vol. IVB, p.411ff, 1977. At least one of $R^7$ to $R^{10}$ must represent hydrogen. It has been found that when each of $R^7$ to $R^{10}$ are other than hydrogen the bleach time and rate of the dye is significantly increased to such an extent that the dyes may not bleach. Similarly, dyes in which n is 0 or 1 do not readily bleach.

The remainder of $R^7$ to $R^{10}$ are selected from hydrogen, optionally substituted alkyl groups generally containing up to 8 carbon atoms, preferably up to 4 carbon atoms, an optionally substituted aryl group, generally containing less than 20 atoms selected from C, N, O and S. Preferably, at least one of $R^8$ and $R^{10}$ represents a phenyl group which may possess one or more substituents selected from halogen, carboxyl groups, alkyl groups containing up to 4 carbon atoms, alkoxy groups containing up to 4 carbon atoms or $R^{11}S$, in which $R^{11}$ represents an alkyl group containing up to 4 carbon atoms.

The free bonds of the polymethine chain are preferably satisfied by hydrogen and optionally one of the carbon atoms may possess a hydroxy group. However, other substituents may be present on the polymethine chain, e.g. alkyl, alkoxy, aryl and aryloxy groups, which groups may be substituted and generally contain up to 8 carbon atoms. Halogen atoms and CN groups may also be substituted on the polymethine chain. Although chain substituents are not generally preferred, they are well known in the cyanine dye art and the choice of substituents is used for fine tuning of the colour of the dye.

$X^{\ominus}$ represents any anion conventionally employed in cyanine dyes, e.g. Cl, Br, etc.

(4) The combination of a polymethine dye as described above and one or more heat sensitive azo-radical generators of the formula:

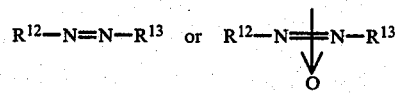

in which:

$R^{12}$ and $R^{13}$ independently represent optionally substituted alkyl groups of up to 10 carbon atoms, or a carbocyclic or heterocyclic ring system generally containing up to 10 atoms other than hydrogen. The combination provides a fast acting dye bleach system sensitive to heat and accordingly may readily be bleached during the thermal development of dry silver elements. The weight ratio of dye:azo generators is generally in the range 1:1 to 1:50.

Suitable azo radical generators are well known and disclosed, for example, in "Free Radicals", W. A. Pryor, McGraw-Hill Co., New York, Chapter 10, p.127 (1966) and "Azo and Diazo Chemistry, Aliphatic & Aromatic Compounds", H. Zollinger, Interscience Pub. Inc., New York, Chap. 12. p.267 (1961). The dye bleach system may be rendered sensitive to light by the addition of mesoionic compounds, e.g. sydnones as described above, or one or more light sensitive onium compounds, e.g. iodonium salt described above.

The antihalo dye (or dyes) is selected to provide a maximum optical absorption for the antihalation layer in the same spectral range as the maximum degree of sensitivity of the photothermographic medium. The dye is coated in an amount to provide an effective optical density when measured by transmission in the range 0.05 to 0.4. The dye is coated together with a binder and preferably includes all the components of the dye bleach system in a single layer. Suitable binders include natural resins, e.g. gelatin, gum arabic, synthetic resins, e.g. polyvinyl acetals, cellulose esters, polyamides, polyacrylates, polymethacrylates, polyurethanes, polyepoxides, polycarbonates, polyvinyl acetate, polyvinyl butyral, polyvinyl alcohol, polyvinyl pyrrolidone, poly(4-vinyl-N-methylpyridinium salt), and other film forming media. The binders may be from thermoplastic to highly cross-linked.

Using a dry silver paper as an example, it is possible by the appropriate computer modelling to explore the distribution of exposure as a function of position within the layer, and to calculate the total net exposure. This can be carried out for example, for different layer thicknesses, different degrees of light absorption, and degrees of reflection from the support.

Figure 1B:
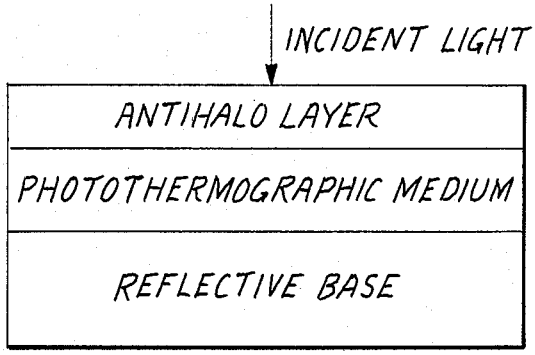
Figure 1C:
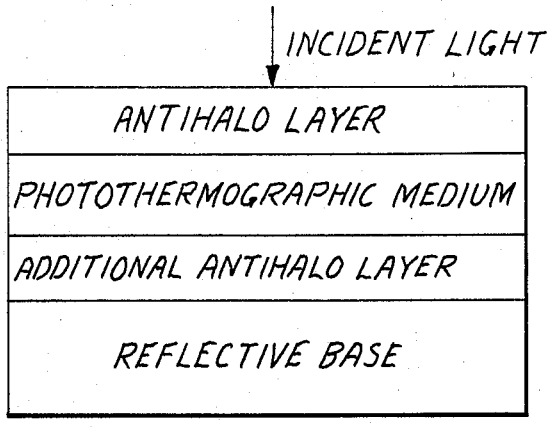

FIGS. 1A to 1C of the accompanying drawings represent cross-sections of dry silver elements indicating the various possible positions of one or more additional layers incorporating antihalo dye. If all the light reflected from the base were to be absorbed, then an antihalo dye must be coated as an underlayer between the sensitive material and the support (1A). If, however, some of the reflected light is considered useful, the dye must be only partially absorbing. By this means multiple passages of light through the layer are absorbed preferentially to single reflections.

A dye in another position in the element, for example, above the sensitive layer (1B) preferentially absorbs multiple reflections in a similar manner. Although the incoming radiation, which is approximately normal to the surface, must traverse the dye layer before entering the sensitive layer, it suffers no further attenuation before it has exposed the layer, once by a "straight-through" passage normal to the support and once by a diffuse passage through the layer, back to the surface.

The same dye quantity coated below the sensitive layer would not attenuate the incoming ray, but would considerably attenuate the exposure due to the first reflection by virtue of the long path lengths of some of the reflected light rays within the dye. It is possible by means of computer modelling, and by experiment to show that a dye in a top layer will produce a useful interchange between sensitivity and image sharpness. In certain instances it has been shown that the interchange was more favourable when the dye was in the top layer.

If the dye was coated within the sensitive layer, the effect would be similar to, and mid-way between the effects of coating the dye above or below the sensitive layer. In such a position the dye could be considered an "acutance" dye, although the term acutance dye generally refers to dyes within a sensitive layer to reduce local scattering within the layer.

In the case of photothermographic materials, the absence of significant local scattering in the sensitive layer ensures that a dye acts essentially as an antihalo dye, in whatever position.

IMAGE SHARPNESS MEASUREMENTS

The increase in image sharpness due to the addition of dye can be verified by a number of methods, the most formal being an evaluation of the modulation transfer function (MTF), by any of the well known methods, using reflection microdensitometry. However, special difficulties arise in defining a precise MTF for reflection materials, and a simpler method has been used. This consists of observing the apparent spread of an image as a function of exposure. At the boundary of an image, the effect of multiple exposures is to increase the area of exposed material, particularly when the image is already exposed to give maximum density, as for example in photo-typesetting applications, or any application where a high contrast image is involved. The usefulness of an antihalo dye is seen as a decrease in the rate of image spread with exposure, compared to the case where no dye is used. An approximately circular patch of light consisting of a broad spectral region appropriately centered on 490 nm was imaged onto the material using a camera lens. Across the test target was an opaque strip producing an area of (nominally) non-exposed material approximately 1.7 mm wide.

Microdensitometer plots across one edge of image at various exposure levels were measured for (a) a dry silver paper material with a quantity of dye coated as an additional top layer, and (b) the same material without the dye layer. By taking some criterion of image spread, e.g. the position where the density is 0.4 above the minimum value, it can be clearly seen that the apparent rate of increase of the exposed area is less when the dye is present. The use of a nominally unexposed strip of known width enables the absolute position of each edge to be determined. For the example described, the width of the unexposed area can be represented graphically as a function of exposure as will be shown hereinafter in the Examples.

The invention will now be illustrated by the following Examples.

The dyes used in the following Examples had the structures reported in the following Table.

TABLE

| Dye No. | Structure | MeOH $\lambda_{max}$ nm |
|---|---|---|
| 1 | 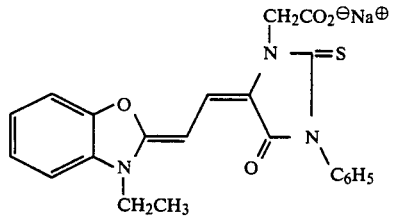 | 489 |
| 2 | 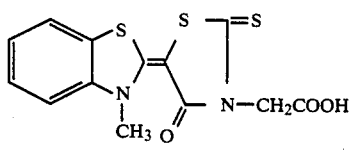 | 426 |
| 3 | 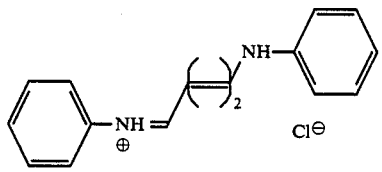 | 495 |
| 4 | 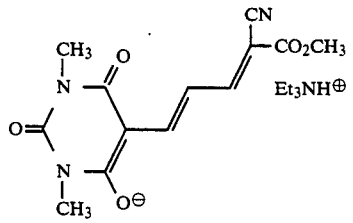 | 450 |

TABLE-continued

| Dye No. | Structure | MeOH $\lambda_{max}$ nm |
|---|---|---|
| 5 | 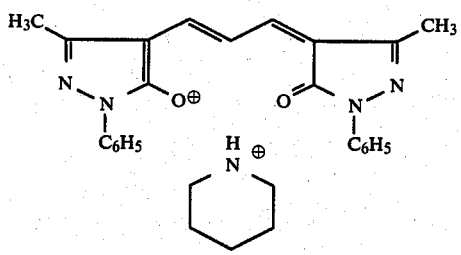 | 525 |

The dry silver elements used in the following Examples were prepared by the following technique.

HALF SILVER SOAP HOMOGENATE

Silver behenate, half-soap homogenate is a 100 g slurry of 45% free behenic acid and 55% silver behenate in 936 ml of acetone, homogenised to a smooth consistency.

| Dry silver formulation | parts by weight |
|---|---|
| silver behenate half-soap homogenate | 60 |
| toluene | 23 |
| polyvinyl butyral (B-76, Monsanto) | 11.05 |
| mercuric bromide solution (10% in methanol) | 0.099 |
| 2,2'-methylene-bis-(4-methyl-6-t-butyl) phenol | 2.2 |
| Dye No. 1 solution (0.1% in methanol) | 1 |
| Dye No. 2 solution (0.1% in methanol) | 2 |

The above composition was coated on vesicular reflecting polyester base (Bexford Ltd.) or other base as indicated, using a knife coater at 3 mil (75 μm) wet thickness. After drying at 80° C. for 3 minutes, a toner layer of the following composition was coated at 3 mil (75 μm) wet thickness and dried at 80° C. for 3 minutes:

| Coating formulation | parts by weight |
|---|---|
| methanol | 9.0 |
| acetone | 69.2 |
| butan-2-one | 15.0 |
| cellulose acetate | 5.2 |
| phthalazine | 0.51 |
| tetrachlorophthalic acid | 0.11 |
| 4-methylphthalic acid | 0.36 |
| tetrachlorophthalic anhydride | 0.085. |

EXAMPLE 1

Testing dry silver image sharpness with top layer and under layer antihalation coatings

| Antihalation layer formulation: | |
|---|---|
| polyvinyl butyral (Butvar B-76, 10% in ethanol) | 10 g |
| 2,2'-methylene-bis-(4-methyl-6-t-butyl) phenol | 0.8 g |
| Dye No. 3 solution (0.4% in MeOH) | 0.8 ml |
| ethanol | 8 ml |
| butan-2-one | 2 ml |

A reference dry silver element was prepared using the dry silver and toner layer formulations as described above and a vesicular polyester base.

A dry silver element having an antihalation underlayer was prepared by coating the base with the above antihalation formulation at 3 mil (75 μm) wet thickness and drying at 70° C. for 2 minutes. A barrier layer formulation of 10% cellulose acetate solution was coated at 3 mil (75 μm) wet thickness over the antihalation layer followed by the standard dry silver and toner layers.

A dry silver element having a topcoat antihalation layer was prepared by coating an element identical to the reference with a barrier layer formulation as described above followed by an antihalation layer formulation as described above.

The elements were exposed at a range of levels through a sharp edged target as described previously and heat developed (127° C. for 5 seconds) to give a dye-free silver image.

The reference dry silver element was also imaged and developed under identical conditions.

Figure 2:
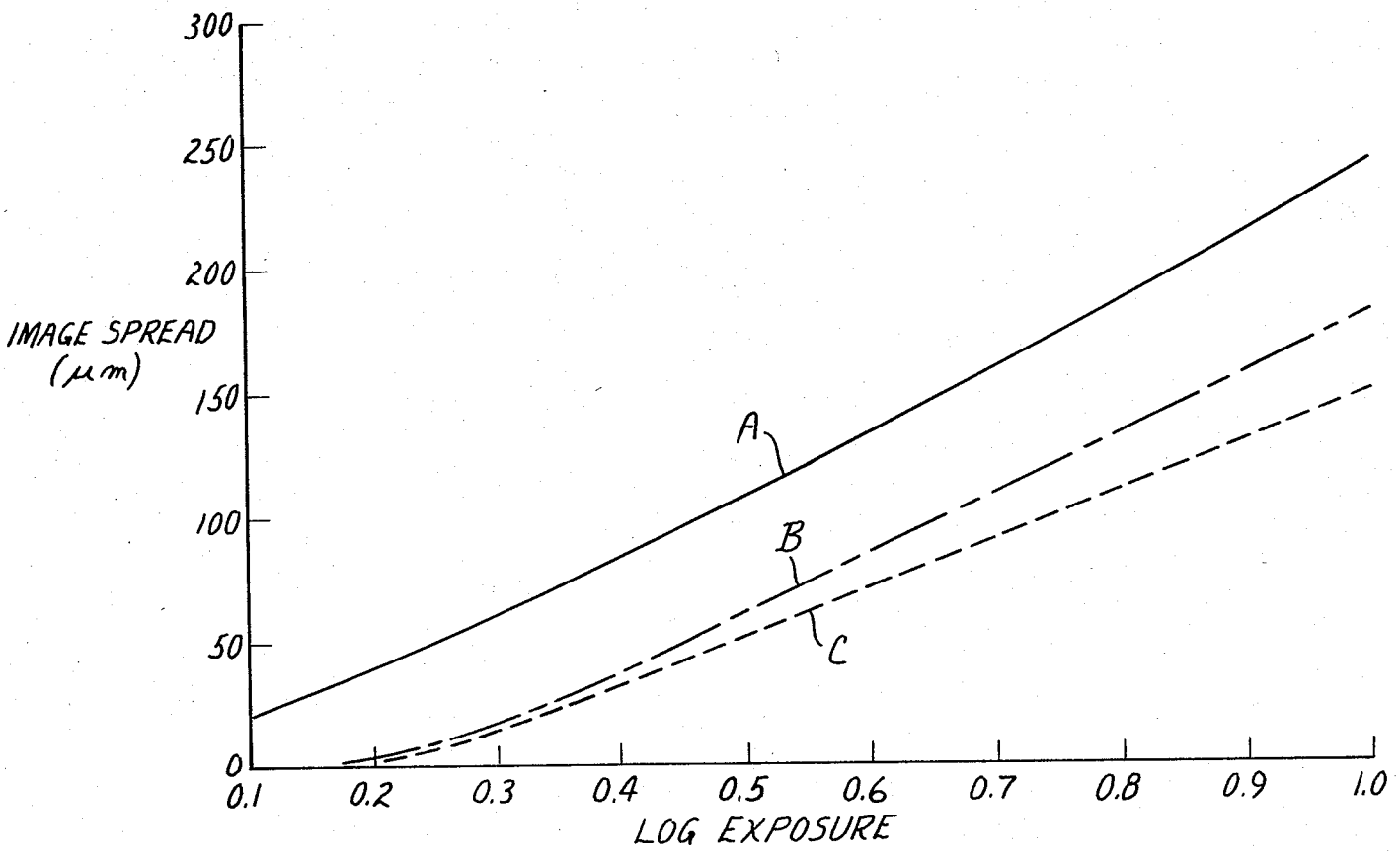

Measurements of the edge positions of the image of the target shown were made on all three coatings. The change in position of an edge is defined at a density level of fog +0.4 as shown in FIG. 2 of the accompanying drawings. The edge position is shown as a function of exposure in excess of that giving maximum density less 0.1. The improvement in image quality is essentially indicated by the gradient of the lines in FIG. 2, the lower gradient indicating lower image spread. It will be seen that the elements of the invention provide improved image quality compared to the equivalent elements with no antihalo dye layer and the top coat antihalation layer provided improved image quality compared to the antihalation underlayer.

In FIG. 2, A represents no antihalation layer, B an antihalation underlayer, and C an uppermost antihalation layer.

EXAMPLE 2

| Light bleachable antihalation layer formulation | |
|---|---|
| diphenyliodonium hexafluorophosphate | 4.0 g |
| acetone | 20 ml |
| toluene | 30 ml |
| polystyrene (molecular weight 100,000) solution (50% in toluene) | 60 g |
| ethyl cellulose solution (10% in toluene) | 20 g |
| Dye No. 4 solution (0.4% in acetone) | 5.0 ml |
| Dye No. 5 solution (0.4% in acetone) | 5.0 ml |

A dry silver element having a topcoat antihalation layer of the above composition was coated on vesicular polyester base bearing the photothermographic and toner layer coatings as used previously. The coating, applied at 3 mil (75 μm) wet thickness was dried in the dark, at 70° C. for 2 minutes.

The antihalation topcoat layer was effective in providing improved image quality compared to a reference element without the antihalation topcoat layer.

The topcoat formulation exposed to a fluorescent "room" light at a distance of 120 cm (output 70 lux without a diffuser) bleached to approximately half its maximum density in 70 seconds and to substantially colourless in ~180 seconds.

EXAMPLE 3

Testing the improvement in image sharpness of a dry silver image on a variety of reflective bases with and without a topcoat antihalation layer

| Antihalation layer formulation | |
|---|---|
| 2,2'-azobisisobutyronitrile | 7.0 g |
| 3-(4-chlorophenyl)sydnone | 1.0 g |
| acetone | 20.0 ml |
| toluene | 30.0 ml |
| polystyrene MW 100,000 solution (50% in toluene) | 60.0 g |
| ethyl cellulose solution (10% in toluene) | 20.0 g |
| Dye No. 4 solution (0.4% in acetone) | 5.0 ml |
| Dye No. 5 solution (0.4% in acetone) | 5.0 ml |

The formulation was coated as a topcoat antihalation layer at 1 mil (25 μm) wet thickness to the dry silver elements having dry silver and toner layers of the type described which had been coated on a variety of bases. Immediately after coating the antihalation formulation the element was dried at 75° C. for 2 minutes to quench dye migration. The bases used were:

41 lb photographic paper base commercially available from Simson Company, Mich.—FIG. 3A;

vesicular grade polyester base commercially available from Bexford Ltd.—FIG. 3B; and $TiO_2$ loaded, resin-coated paper base—FIG. 3C.

Each element was exposed at a range of levels through a sharp edged target as described previously and heat developed (127° C. for 5 seconds) to give a dye-free silver image.

Reference dry silver materials with no antihalation layer were also imaged and developed under identical conditions. FIGS. 3D, E and F respectively.

The dyes used in the antihalation layer are known to cause chemical fogging when in reactive association with the silver soap. Since no excessive fog levels were observed in the coatings of the invention containing the antihalation layer as compared to the reference, dye migration into the light sensitive layer had been prevented.

Figure 3:
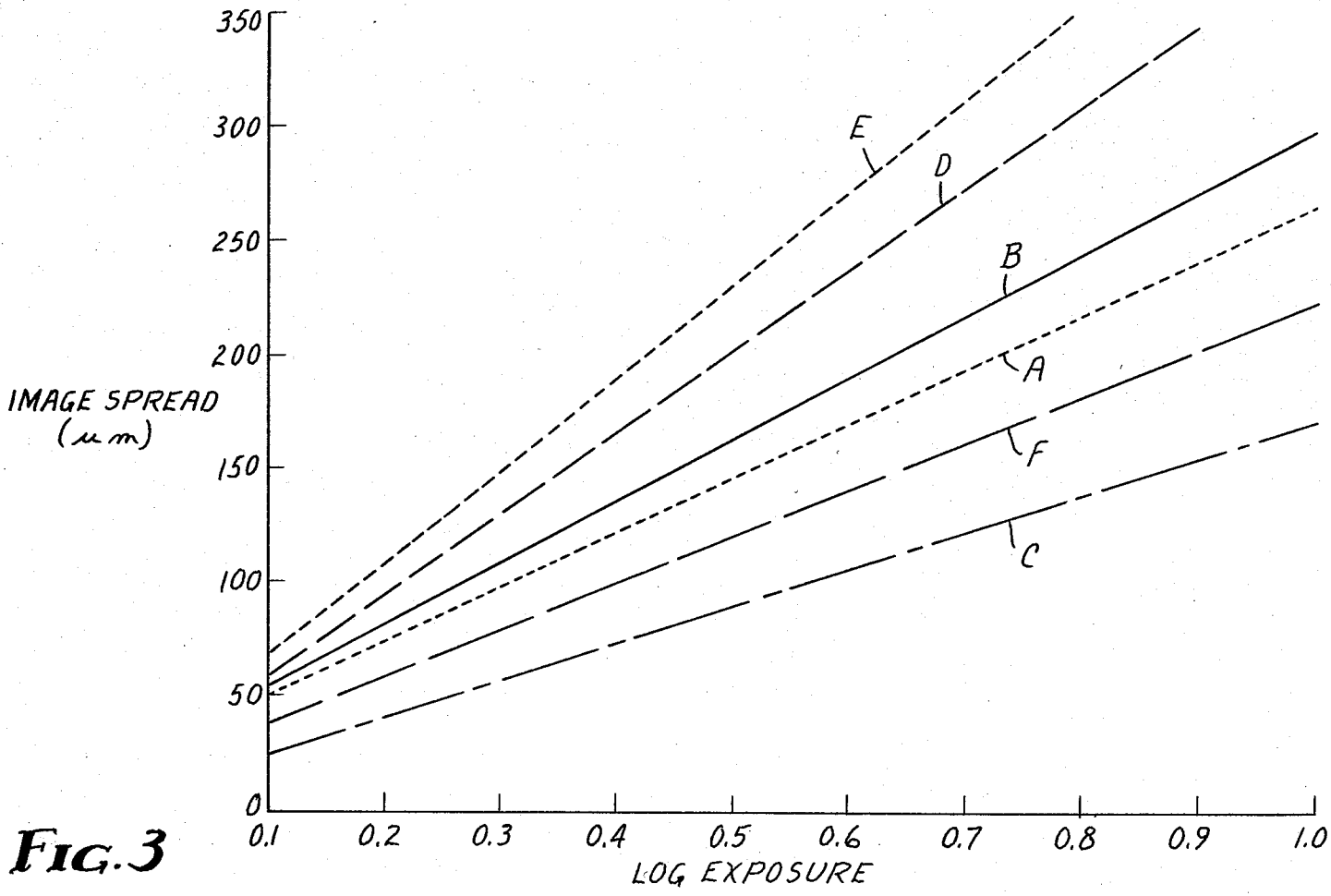
FIG. 3 represents a similar plot to FIG. 2 comparing the image spread obtained using dry silver elements having different reflective bases with and without an antihalation layer in accordance with the invention. The detailed experimental conditions are reported in Example 3.

Measurements of the edge positions of the target were made on all the coatings. The change in position of an edge is defined at a density level of fog +0.4 as shown in FIG. 3 of the accompanying drawings. The edge position is shown as a fuction of exposure in excess of that giving maximum density less 0.1. It is difficult to define the exact exposure giving maximum density due to differences in the shapes of the D/log E curves of experimental coatings and accordingly the positions of the lines in FIG. 3 along the abscissa are subject to error. However, the improvement in image quality is essentially indicated by the gradient of the lines in FIG. 3, the lower gradient indicating lower image spread. It will be seen that the elements of the invention provide improved image quality compared to the equivalent elements with no antihalo dye.

EXAMPLE 4

Heat/light bleachable antihalation topcoat layer

| Antihalation layer formulation | |
|---|---|
| 2,2'-azobisisobutyronitrile | 7.0 g |
| 3-(4'-chlorophenyl)sydnone | 1.0 g |
| diphenylliodonium hexafluorophosphate | 1.0 g |
| acetone | 20.0 ml |
| toluene | 30.0 ml |
| polystyrene MW 100,000 solution (50% in toluene) | 60.0 g |
| ethyl cellulose (10% in toluene) | 20.0 g |
| Dye No. 4 solution (0.4% in acetone) | 5.0 ml |
| Dye No. 5 solution (0.4% in acetone) | 5.0 ml |

A dry silver element comprising a vesicular polyester base bearing the photothermographic and toner layer coatings used previously was provided with a topcoat antihalation layer of the above formulation. The coating, applied at 3 mil (75 μm) wet thickness was dried in the dark, at 70° C. for 2 minutes.

The dry silver element was exposed and developed by heating for 3 seconds at 127° C. The antihalation topcoat layer bleached from reddish-magenta to essentially colourless.

A sample of the topcoat formulation was exposed to a fluorescent "room" light at a distance of 120 cm (output 70 lux without a diffuser) and bleached to approximately half its maximum density in 70 seconds and to a substantially colourless form in approximately 180 seconds.

EXAMPLE 5

Testing dry silver image sharpness with a topcoat antihalation layer compared with antihalo dyes within the light sensitive layer A dry silver element with no antihalation layer or acutance dye was prepared as described above on a vesicular polyester base. The element was used as a reference—FIG. 4A.

Dye No. 3 in a 0.4% by weight solution in methanol was added to a toner formulation as described above in an amount to provide 2% by weight of dye solution in the formulation. A dry silver element was prepared in an analogous manner to the reference element using the modified toner formulation in place of the unmodified formulation—FIG. 4B.

A dry silver element identical to the reference element was provided with a topcoat antihalation layer using the formulation of Example 3 with the exception that the antihalo dye used was Dye No. 3. The overall dye densities of this element and the preceding element were equivalent (approximately 0.1 by transmission)—FIG. 4C.

Figure 4:
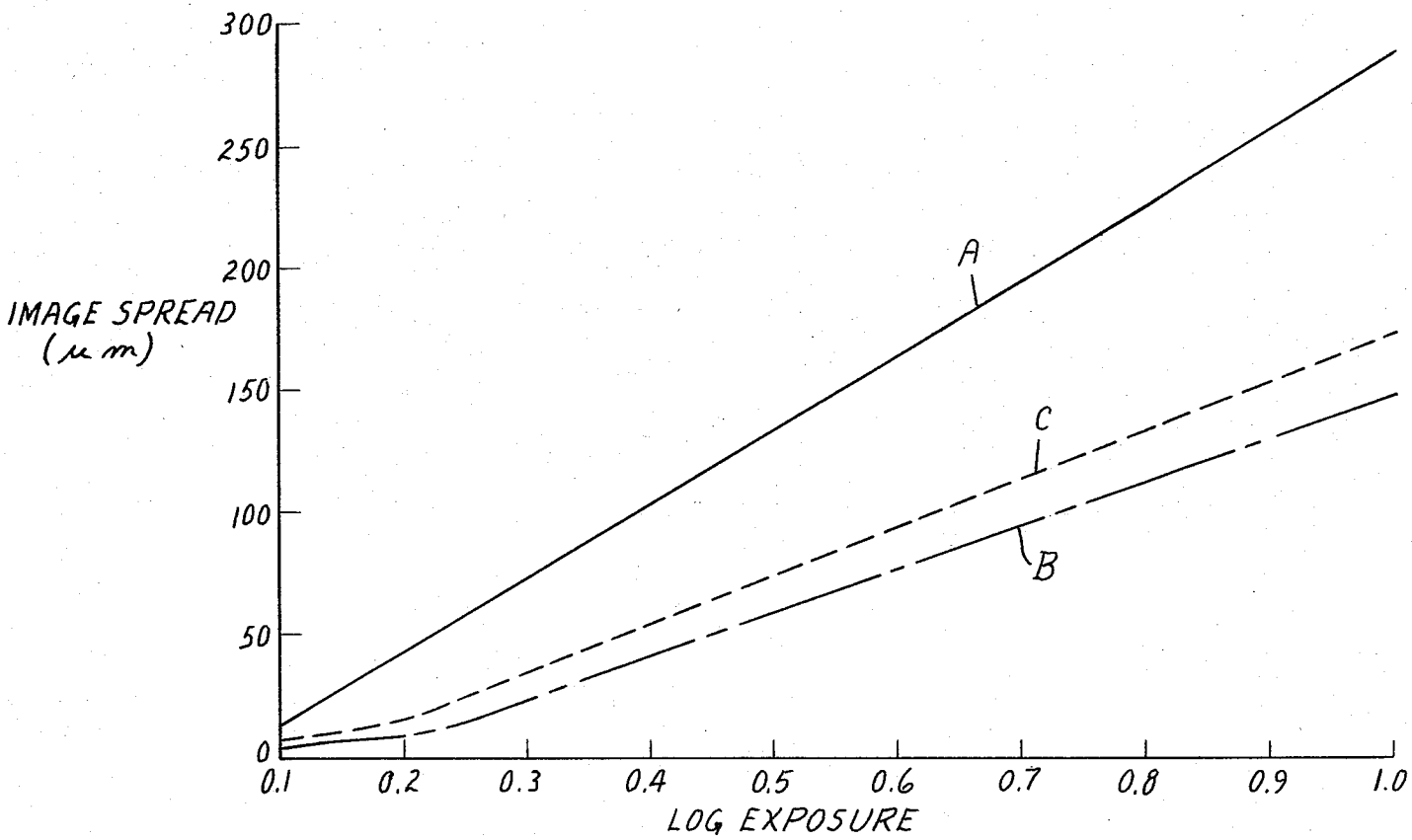
FIG. 4 represents a similar plot to FIG. 2 comparing the image spread obtained using dry silver elements having an antihalation layer in accordance with the invention compared with similar elements having no antihalation layer and an element having an antihalation dye within the toner layer. The detailed experimental conditions are reported in Example 5.

Edge sharpness measurements were conducted as in Example 3 and the results in the form of a plot of image spread against log exposure in excess to that necessary to give a density above 1.3 are reported in FIG. 4. It will be seen that the presence of an antihalo dye within the top toner layer or on top of the dry silver medium improves image sharpness to a comparable extent.

We claim:

1. A photothermographic element comprising a reflective base having coated thereon one or more layers constituting a dry silver photothermographic imaging medium having a mixture of light sensitive silver halide, a silver salt of an organic fatty acid and an organic reducing agent characterised in that a dye containing bleachable antihalation medium is coated over said photothermographic imaging medium, the dye and other components of the antihalation medium necessary to complete a dye/bleach system which is non-reactive with the silver halide, silver salt and organic reducing agent in the photothermographic imaging medium, the dye bleach system being in a different layer from said imaging medium.

2. A photothermographic element as claimed in claim 1, characterised in that the antihalation layer contains one or more dyes in an amount to provide an optical density when measured by transmission in the range 0.05 to 0.4, said dye(s) being in reactive association with any other components necessary to complete a dye/-bleach system which allows bleaching of the dye(s) under the influence of light and/or heat.

3. An element as claimed in claim 2, characterised in that the photothermographic medium is a dry silver system comprising a mixture of light sensitive silver halide, a silver salt of an organic fatty acid and an organic reducing agent.

4. An element as claimed in claim 2, characterised in that a barrier layer is present between the photothermographic medium and the antihalation layer.

5. An element as claimed in claim 1, characterised in that the antihalation layer comprises a polymethine dye and a mesoionic compound in a weight ratio of dye:mesoionic compound in the range 1:1 to 1:50.

6. An element as claimed in claim 2, characterised in that the antihalation layer comprises a polymethine dye and a mesoionic compound in a weight ratio of dye:mesoionic compound in the range 1:1 to 1:50.

7. An element as claimed in claim 1, characterised in that the antihalation layer comprises a polymethine dye and a mesoionic compound in a weight ratio of dye:mesoionic compound in the range 1:1 to 1:50.

8. An element as claimed in claim 5, characterised in that the mesoionic compound is a sydnone of the formula:

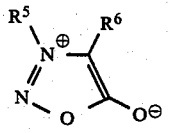

(II)

in which:

$R^5$ represents an alkyl or aryl group or a heterocyclic ring, any of which groups may be substituted, and $R^6$ represents an alkyl or aryl group either of which may be substituted, a hydrogen atom, an amino or an alkoxy group, preferably $R^6$ represents a hydrogen atom.

9. An element as claimed in claim 1, characterised in that the antihalation layer comprises a polymethine dye having an oxidation potential between 0 and +1 volt and an iodonium salt in the weight ratio of dye:iodonium salt in the range 1:1 to 1:50.

10. An element as claimed in claim 2, characterised in that the antihalation layer comprises a polymethine dye having an oxidation potential between 0 and +1 volt and an iodonium salt in the weight ratio of dye:iodonium salt in the range 1:1 to 1:50.

11. An element as claimed in claim 1, characterised in that the antihalation layer comprises a polymethine dye having an oxidation potential between 0 and +1 volt and an iodonium salt in the weight ratio of dye:iodonium salt in the range 1:1 to 1:50.

12. An element as claimed in claim 1, characterised in that the iodonium salt has the formula:

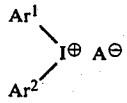

(III)

in which:

$Ar^1$ and $Ar^2$ independently represent carbocyclic or heterocyclic aromatic-type groups having from 4 to 20 carbon atoms, or together with the iodine atom complete a heterocyclic aromatic ring.

13. An element as claimed in claim 1, characterised in that the antihalation layer comprises a polymethine dye and one or more heat sensitive azo-radical generators of the formula:

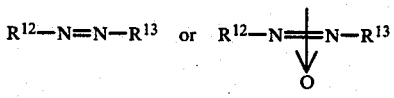

in which:

$R^{12}$ and $R^{13}$ independently represent alkyl groups of up to 10 carbon atoms, substituted or not, or a carbocyclic or heterocyclic ring system containing up to 10 atoms other than hydrogen.

14. An element as claimed in claim 4, characterised in that the antihalation layer comprises a polymethine dye and one or more heat sensitive azo-radical generators of the formula:

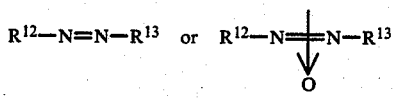

in which:

$R^{12}$ and $R^{13}$ independently represent alkyl groups of up to 10 carbon atoms, substituted or not, or a carbocyclic or heterocyclic ring system containing up to 10 atoms other than hydrogen.

15. An element as claimed in claim 5, characterised in that the polymethine dye has the formula:

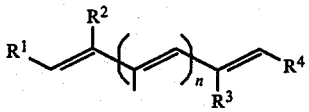

(I)

in which:

n is an integer of 1 to 5, and $R^1$ to $R^4$ are selected to provide an electron donor moiety at one end of the conjugated chain and an electron acceptor moiety at the other, and represent halogen, alkyl, aryl groups or heterocyclic rings, substituted or not substituted, said groups containing up to 14 atoms selected from C, N, O and S; or $R^1$ and $R^2$ and/or $R^3$ and $R^4$ may represent the necessary atoms to complete aryl groups or heterocyclic rings, substituted or not substituted, containing up to 14 atoms selected from C, N, O and S.

16. An element as claimed in claim 6, characterised in that the polymethine dye has the formula:

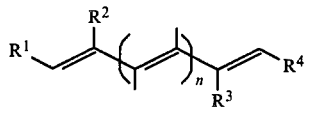

(I)

in which:

n is an integer of 1 to 5, and $R^1$ to $R^4$ are selected to provide an electron donor moiety at one end of the conjugated chain and an electron acceptor moiety at the other, and represent halogen, alkyl, aryl groups or heterocyclic rings any of which may be substituted, said groups containing up to 14 atoms selected from C, N, O and S; or $R^1$ and $R^2$ and/or $R^3$ and $R^4$ may represent the necessary atoms to complete aryl groups or heterocyclic rings, substituted or not, generally containing up to 14 atoms selected from C, N, O and S.

17. An element as claimed in claim 1, characterised in that the antihalation layer comprises a cyanine of the structure:

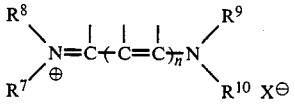

(V)

in which:

n is 2, 3, 4 or 5, at least one of $R^7$ to $R^{10}$ represent hydrogen and the remainder of $R^7$ to $R^{10}$ independently represent a hydrogen atom, an cycloalkyl group, an alkenyl group, an alkyl group, an aryl group, an heterocyclic aromatic group, any of which groups may be substituted or not, or $R^7$ and $R^8$ together or $R^9$ and $R^{10}$ together represent the necessary atoms selected from C, N, O and S to complete a non-aromatic type ring, $X^{\ominus}$ is an anion, the free bonds of the polymethine chain being satisfied by hydrogen or any chain substituent of the type present in known cyanine dyes, the bleachable dye optionally being in reactive association with a mild reducing agent.

18. An element as claimed in claim 4, characterised in that the antihalation layer comprises a cyanine of the structure:

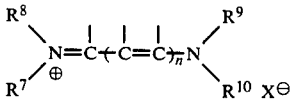

(V)

in which:

n is 2, 3, 4 or 5, at least one of $R^7$ to $R^{10}$ represent hydrogen and the remainder of $R^7$ to $R^{10}$ independently represent a hydrogen atom, an cycloalkyl group, an alkenyl group, an alkyl group, an optionally substituted aryl group, an heterocyclic aromatic group, any of which groups may be substituted or not, or $R^7$ and $R^8$ together or $R^9$ and $R^{10}$ together represent the necessary atoms selected from C, N, O and S to complete a non-aromatic type ring, $X^{\ominus}$ is an anion, the free bonds of the polymethine chain being satisfied by hydrogen or any chain substituent of the type present in known cyanine dyes, the bleachable dye optionally being in reactive association with a mild reducing agent.

* * * * *